US010533813B2

(12) United States Patent
Baxter et al.

(10) Patent No.: US 10,533,813 B2
(45) Date of Patent: Jan. 14, 2020

(54) METHOD FOR SEMI-CONTINUOUS HEAT EXCHANGE OPERATIONS BY ALTERNATING BETWEEN HEAT EXCHANGERS

(71) Applicants: Larry Baxter, Orem, UT (US); Eric Mansfield, Spanish Fork, UT (US); Christopher Hoeger, Provo, UT (US); Kyler Stitt, Lindon, UT (US); David Frankman, Provo, UT (US); Stephanie Burt, Provo, UT (US); Aaron Sayre, Spanish Fork, UT (US); Nathan Davis, Bountiful, UT (US)

(72) Inventors: Larry Baxter, Orem, UT (US); Eric Mansfield, Spanish Fork, UT (US); Christopher Hoeger, Provo, UT (US); Kyler Stitt, Lindon, UT (US); David Frankman, Provo, UT (US); Stephanie Burt, Provo, UT (US); Aaron Sayre, Spanish Fork, UT (US); Nathan Davis, Bountiful, UT (US)

(73) Assignee: Hall Labs LLC, Provo, UT (US)

( * ) Notice: Subject to any disclaimer, the term of this patent is extended or adjusted under 35 U.S.C. 154(b) by 343 days.

(21) Appl. No.: 15/425,276

(22) Filed: Feb. 6, 2017

(65) Prior Publication Data

US 2018/0224225 A1 Aug. 9, 2018

(51) Int. Cl.

| | |
|---|---|
| ***F28G 9/00*** | (2006.01) |
| ***F28G 15/00*** | (2006.01) |
| ***F28G 13/00*** | (2006.01) |
| *F28D 21/00* | (2006.01) |

(52) U.S. Cl.
CPC ..... *F28G 9/00* (2013.01); *F28G 13/005* (2013.01); *F28G 15/003* (2013.01); *F28D 2021/0022* (2013.01)

(58) Field of Classification Search
CPC ..... F28G 9/00; F28G 15/003; F28G 13/005; F28D 2021/0022; F25J 3/08
See application file for complete search history.

(56) References Cited

U.S. PATENT DOCUMENTS 4,551,981 A * 11/1985 Banerjee ..... B01D 5/0027 62/47.1
5,089,034 A * 2/1992 Markovs ..... B01D 53/04 95/123

(Continued)

*Primary Examiner* — Emmanuel E Duke

(57) ABSTRACT

A method for semi-continuous operation of a heat exchange process that alternates between two heat exchangers is disclosed. The method comprises, first, providing a contact liquid to a first heat exchanger while the second heat exchanger is on standby. The contact liquid contains a dissolved gas, an entrained gas, or residual small particles that foul the first heat exchanger by condensing or depositing as a foulant onto the first heat exchanger, restricting free flow of the contact liquid. Second, detecting a pressure drop across the first heat exchanger. Third, switching flows of the coolant from the first to the second heat exchanger. Fourth, removing the foulant from the now standby first heat exchanger by providing heat to the heat exchanger, passing a non-reactive gas through the heat exchanger, or a combination thereof. In this manner, the heat exchange process operates semi-continuously.

20 Claims, 5 Drawing Sheets

(56) References Cited

U.S. PATENT DOCUMENTS

| | | | | |
|---|---|---|---|---|
| 5,424,051 | A * | 6/1995 | Nagji | B01D 53/04 423/234 |
| 6,419,888 | B1 * | 7/2002 | Wyckoff | C10L 3/10 423/220 |
| 6,564,579 | B1 * | 5/2003 | McCartney | F17C 9/02 62/620 |
| 8,138,381 | B2 * | 3/2012 | Joshi | C07C 29/1518 518/700 |
| 9,453,174 | B2 * | 9/2016 | Acikgoz | C10L 3/104 |
| 9,518,239 | B2 * | 12/2016 | Doong | C10L 3/103 |
| 2003/0158458 | A1 * | 8/2003 | Prim | C07D 7/04 585/800 |
| 2013/0309738 | A1 * | 11/2013 | Barr | C12P 7/16 435/160 |

* cited by examiner

METHOD FOR SEMI-CONTINUOUS HEAT EXCHANGE OPERATIONS BY ALTERNATING BETWEEN HEAT EXCHANGERS

This invention was made with government support under DE-FE0028697 awarded by. The Department of Energy. The government has certain rights in the invention.

BACKGROUND

Field of the Invention

This invention relates generally to the field of heat exchanger operations. Our immediate interest is in preventing stoppage of operations of a cryogenic heat exchange process due to fouling.

Related Technology

Heat exchange is a fundamental unit operation in nearly all chemical processes, from simple in-home heaters to extraordinarily complex industrial furnaces. The art of cryogenic heat exchange is a less mature branch of industrial heat exchange. Cryogenic heat exchange adds a new problem to heat exchange. Whereas traditional heat exchangers are typically blocked by scale formation or deposition of entrained solids, cryogenic heat exchangers can also be blocked by constituents in the process fluid condensing out of the process fluid and depositing onto the walls of the heat exchanger. These deposits can not only exacerbate deposition of entrained solids, but can block the heat exchanger independently.

Fouling removal methods are common and can include techniques ranging from the complexity of dismantling the system to manually remove scale to the simplicity of banging on the exchanger with a hammer. However, removal of cryogenic deposits is not addressed well by these techniques as continuous operations are very important at these low temperatures.

Further, heat exchangers are not inexpensive pieces of equipment. While the standard in heavy industry is to have spare, in-line equipment for some operations, such as pumps, larger capital equipment is often too expensive to keep one spare and one standby. Even when there are spare heat exchangers, switching between these exchangers often results in significant downtime. Cryogenics, being a relatively young industry, requires better methods for maintaining continuous or semi-continuous operations.

With the need for cryogenic heat exchange on the rise, new methods are needed to address any limitations that exist.

United States patent publication number 2006/0156744 to Cusiter teaches a liquefied natural gas floating storage regasification unit. This disclosure is pertinent and may benefit from semi-continuous heat exchanger methods disclosed herein and is hereby incorporated for reference in its entirety for all that it teaches.

United States patent publication number 2008/0073063 to Clavenna et al. teaches a method for reduction of fouling in heat exchangers. This disclosure is pertinent and may benefit from semi-continuous heat exchanger methods disclosed herein and is hereby incorporated for reference in its entirety for all that it teaches.

SUMMARY

A method for semi-continuous operation of a heat exchange process that alternates between a first heat exchanger and a second heat exchanger is disclosed. The method comprises, first, providing a contact liquid to a first heat exchanger to cool via heat exchange with a coolant while the second heat exchanger is on standby. The contact liquid contains a dissolved gas, an entrained gas, or residual small particles that foul the first heat exchanger by condensing or depositing as a foulant onto at least a portion of the interior walls of the first heat exchanger, restricting free flow of the contact liquid. Second, detecting a pressure drop across the first heat exchanger, the first heat exchanger operating while the second heat exchanger is on standby. Third, stopping flow of the coolant to the first heat exchanger, beginning flow of the contact liquid to the second heat exchanger, stopping flow of the contact liquid to the first heat exchanger, and beginning flow of the coolant to the second heat exchanger. Fourth, removing the foulant from the now standby first heat exchanger by providing heat to the portion of the interior walls of the heat exchanger where the foulant is condensed, passing a non-reactive gas across the portion of the interior walls of the heat exchanger where the foulant is condensed, or a combination thereof. At this point, the first heat exchanger and the second heat exchanger switch roles from standby to operating, and steps i to iv repeated with reversed roles, as necessary. In this manner, the heat exchange process operates semi-continuously.

In some embodiments of the present invention, the foulant comprises carbon dioxide, nitrogen oxide, sulfur dioxide, nitrogen dioxide, sulfur trioxide, hydrogen sulfide, mercury, entrained particulate, hydrogen cyanide, impurities of burned fuel, byproducts of burned fuel, or a combination thereof.

In some embodiments of the present invention, the contact liquid comprises 1,1,3-trimethylcyclopentane, 1,4-pentadiene, 1,5-hexadiene, 1-butene, 1-methyl-1-ethylcyclopentane, 1-pentene, 2,3,3,3-tetrafluoropropene, 2,3-dimethyl-1-butene, 2-chloro-1,1,1,2-tetrafluoroethane, 2-methylpentane, 3-methyl-1,4-pentadiene, 3-methyl-1-butene, 3-methyl-1-pentene, 3-methylpentane, 4-methyl-1-hexene, 4-methyl-1-pentene, 4-methylcyclopentene, 4-methyl-trans-2-pentene, bromochlorodifluoromethane, bromodifluoromethane, bromotrifluoroethylene, chlorotrifluoroethylene, cis 2-hexene, cis-1,3-pentadiene, cis-2-hexene, cis-2-pentene, dichlorodifluoromethane, difluoromethyl ether, trifluoromethyl ether, dimethyl ether, ethyl fluoride, ethyl mercaptan, hexafluoropropylene, isobutane, isobutene, isobutyl mercaptan, isopentane, isoprene, methyl isopropyl ether, methylcyclohexane, methylcyclopentane, methylcyclopropane, n,n-diethylmethylamine, octafluoropropane, pentafluoroethyl trifluorovinyl ether, propane, sec-butyl mercaptan, trans-2-pentene, trifluoromethyl trifluorovinyl ether, vinyl chloride, bromotrifluoromethane, chlorodifluoromethane, dimethyl silane, ketene, methyl silane, perchloryl fluoride, propylene, vinyl fluoride, or combinations thereof.

In some embodiments of the present invention, the heat exchanger comprises a brazed plate, aluminum plate, shell and tube, plate, plate and frame, plate and shell, or plate fin style heat exchanger.

In some embodiments of the present invention, the non-reactive gas comprises nitrogen, methane, argon, or combinations thereof.

In some embodiments of the present invention, the non-reactive gas is pre-heated and moisture removed by passing the non-reactive gas across a desiccant.

In some embodiments of the present invention, the heat provided to the interior walls of the fouled heat exchanger is provided by heating elements attached to the heat exchanger.

These heating elements can be attached to an exterior wall of the heat exchanger. The contact liquid can travel through the exterior elements of the heat exchanger. In other embodiments, the contact liquid travels through interior elements of the heat exchanger. In this latter case, the heating elements can be attached to the outside of the interior elements.

In some embodiments of the present invention, the heating elements are comprised of piezoelectric heaters, heat trace tape, heat trace sheets, band heaters, or combinations thereof.

In some embodiments of the present invention, the heating elements are located at the inlet and outlet of the interior elements to the heat exchanger. In this instance, the heating elements warm only the portion of the interior elements that extend out of the heat exchanger, and heat is conducted along the interior elements.

In one embodiment of the present invention, the heat exchangers are shell and tube style heat exchangers, as in FIG. 5. The tube has varying pipe diameters, which may be useful for resisting and clearing fouling because of the changes in flow rates and pressure drops adding turbulence to the flow along the length of the tube.

In some embodiments of the present invention, the contact liquid travels through interior elements of the heat exchanger and the heat provided to the interior walls of the heat exchanger is provided by passing a warm fluid through the outer elements of the heat exchanger. The warm fluid can be air, nitrogen, carbon dioxide, argon, or combinations thereof. The warm fluid may also be a liquid such as water or one of the contact liquids mentioned above.

In some embodiments of the present invention, the heating elements are attached to the inside of the interior elements. The heating elements are comprised of piezoelectric heaters, heat trace tape, heat trace sheets, or combinations thereof.

In one embodiment of the present invention, after shutdown of the restricted heat exchanger, the connections to the interior elements by external piping are disconnected and the heating elements are inserted into the inside of the interior elements.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, may be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention.

Figure 1:
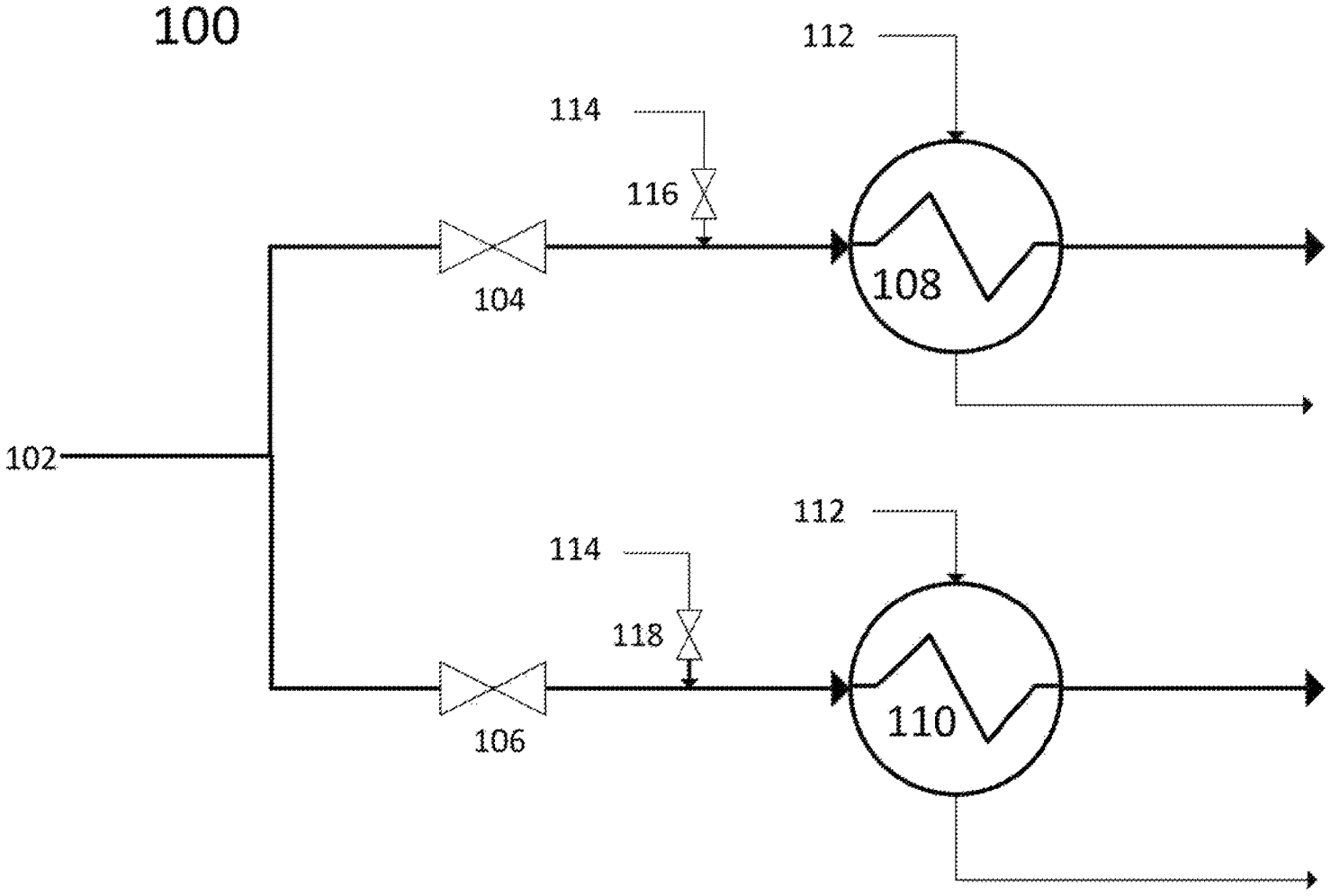
FIG. 1 shows a process flow diagram for one embodiment of the present invention.

Referring to FIG. 1, a process flow diagram 100 is provided, showing one embodiment of the present invention. A contact liquid 102 is provided by pipe to valve 104 and valve 106, in parallel. Initially, valve 104 is open and valve 106 is closed. Contact liquid 102 continues into heat exchanger 108. Contact liquid 102 contains a dissolved gas, an entrained gas, or residual small particles that foul heat exchanger 108 by condensing or depositing as a foulant onto at least a portion of the interior walls of the interior elements of heat exchanger 108, restricting free flow of contact liquid 102. The pressure across heat exchanger 108 is monitored and when the pressure drops, signifying less contact liquid 102 is making it through heat exchanger 108, the flow of coolant 112 to heat exchanger 108 is stopped. Valve 106 is opened and contact liquid 102 begins to flow to heat exchanger 110. Flow of coolant 112 is begun to heat exchanger 110. Valve 104 is closed, stopping flow of contact liquid 102 to heat exchanger 108. At this point, heat exchanger 110 is now in operation while heat exchanger 108 is ready for removal of fouling. Valve 116 is opened and a non-reactive gas 114 is passed across the interior interior walls of the interior elements of heat exchanger 108 where the foulant is condensed. The foulant removed, heat exchanger 108 becomes the standby for heat exchanger 110. The same process would be repeated for opposite exchangers when a pressure drop across heat exchanger 110 is detected, but utilizing valve 118. Non-reactive gas 112 is at any temperature above that required to heat the foulant and cause evaporation.

Figure 2:
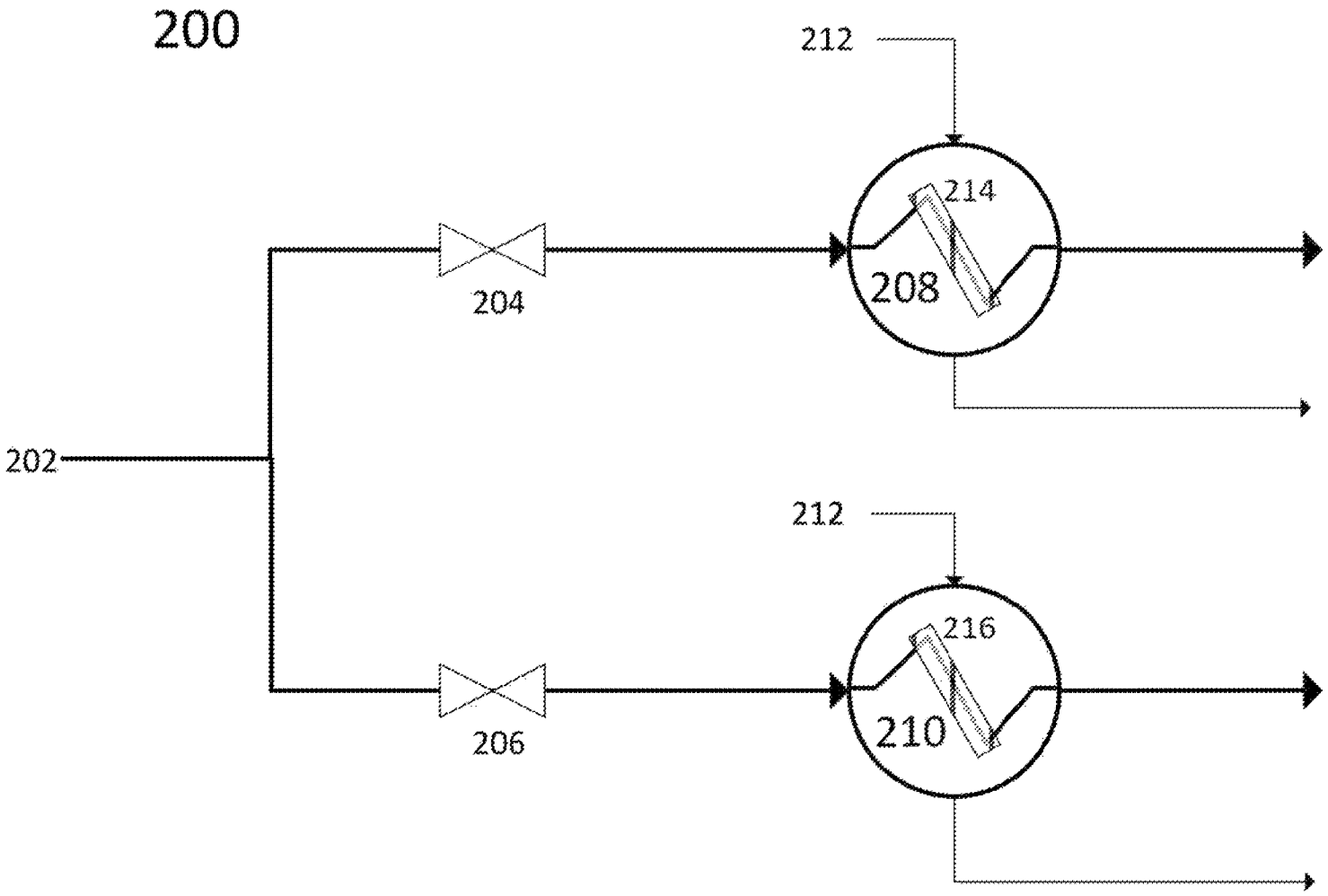
FIG. 2 shows a process flow diagram for one embodiment of the present invention.

Referring to FIG. 2, a process flow diagram 200 is provided, showing one embodiment of the present invention. A contact liquid 202 is provided by pipe to valve 204 and valve 206, in parallel. Initially, valve 204 is open and valve 206 is closed. Contact liquid 202 continues into heat exchanger 208. Contact liquid 202 contains a dissolved gas, an entrained gas, or residual small particles that foul heat exchanger 208 by condensing or depositing as a foulant onto at least a portion of the interior interior walls of the interior elements of heat exchanger 208, restricting free flow of contact liquid 202. The pressure across heat exchanger 208 is monitored and when the pressure drops, signifying less contact liquid 202 is making it through heat exchanger 208, the flow of coolant 212 to heat exchanger 208 is stopped. Valve 206 is opened and contact liquid 202 begins to flow to heat exchanger 210. Flow of coolant 212 is begun to heat exchanger 210. Valve 204 is closed, stopping flow of contact liquid 202 to heat exchanger 208. At this point, heat exchanger 210 is now in operation while heat exchanger 208 is ready for removal of fouling. Heating element 214, attached to the exterior walls of the interior elements of heat exchanger 208, is engaged to warm the interior elements of heat exchanger 208, driving off the foulant. The foulant removed, heat exchanger 208 becomes the standby for heat exchanger 210. The same process would be repeated for opposite exchangers when a pressure drop across heat exchanger 210 is detected. Heating elements 216 would be used for removing fouling of heat exchanger 210. In some embodiments, heating elements 214 and 216 would be attached to the entire surface of the interior elements. In other embodiments, heating elements 214 and 216 would only be attached to the portion of the interior elements that are exposed at the entrance and exit of heat exchanger 408 and 410, respectively.

Figure 3:
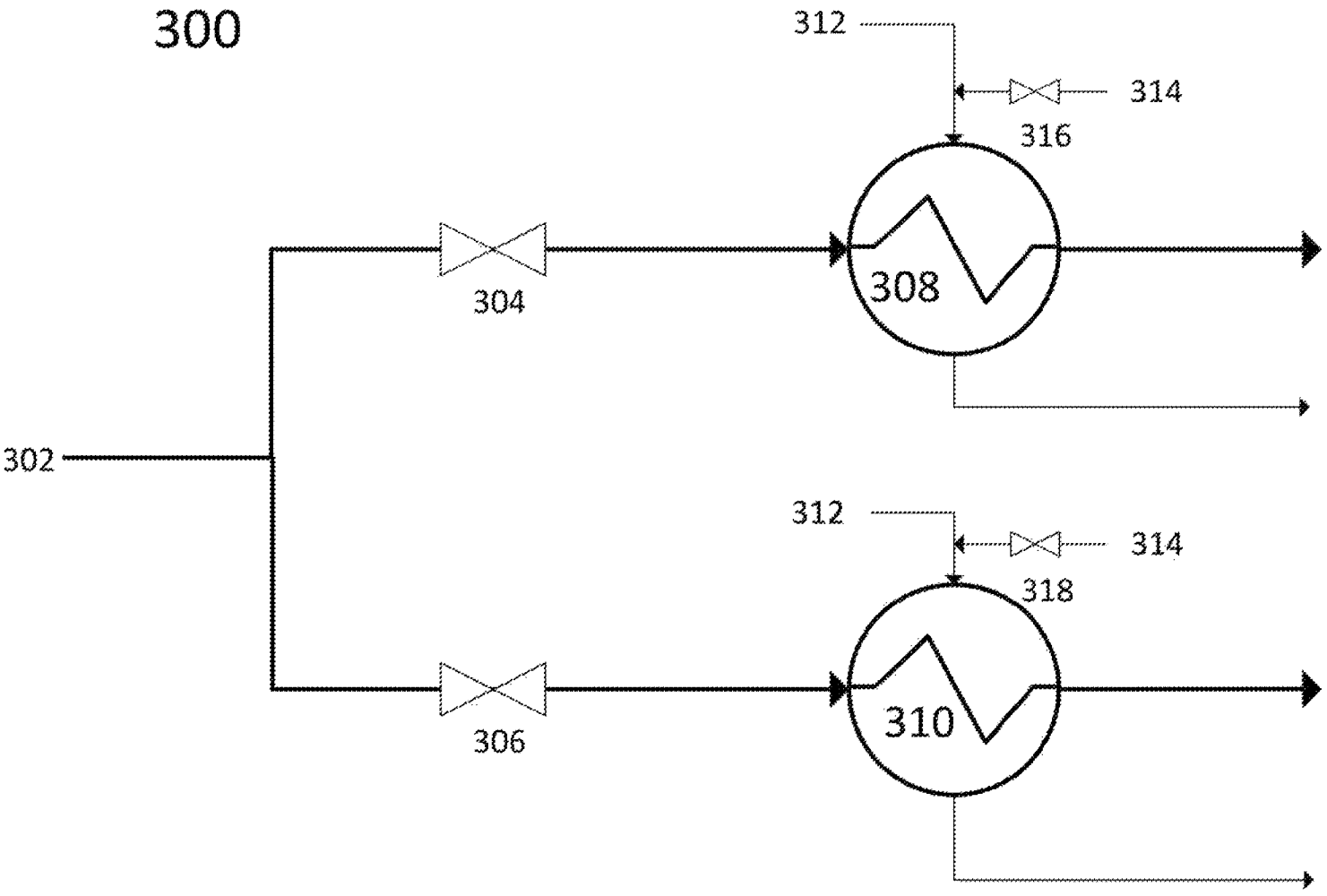
FIG. 3 shows a process flow diagram for one embodiment of the present invention.

Referring to FIG. 3, a process flow diagram 300 is provided, showing one embodiment of the present invention. A contact liquid 302 is provided by pipe to valve 304 and valve 306, in parallel. Initially, valve 304 is open and valve 306 is closed. Contact liquid 302 continues into heat exchanger 308. Contact liquid 302 contains a dissolved gas, an entrained gas, or residual small particles that foul heat exchanger 308 by condensing or depositing as a foulant onto at least a portion of the interior walls of the interior elements of heat exchanger 308, restricting free flow of contact liquid 302. The pressure across heat exchanger 308 is monitored and when the pressure drops, signifying less contact liquid 302 is making it through heat exchanger 308, the flow of coolant 312 to heat exchanger 308 is stopped. Valve 306 is opened and contact liquid 302 begins to flow to heat exchanger 310. Flow of coolant 312 is begun to heat exchanger 310. Valve 304 is closed, stopping flow of contact liquid 302 to heat exchanger 308. At this point, heat exchanger 310 is now in operation while heat exchanger 308 is ready for removal of fouling. Valve 316 is opened and a warm fluid 314 is passed through the outer elements of heat exchanger 308 in place of coolant 312. This warms the interior elements, causing the foulant to be removed. The foulant removed, heat exchanger 308 becomes the standby for heat exchanger 310. The same process would be repeated for opposite exchangers when a pressure drop across heat exchanger 310 is detected, but utilizing valve 318. Warm fluid 314 is at any temperature above that required to heat the foulant and cause evaporation.

Figure 4:
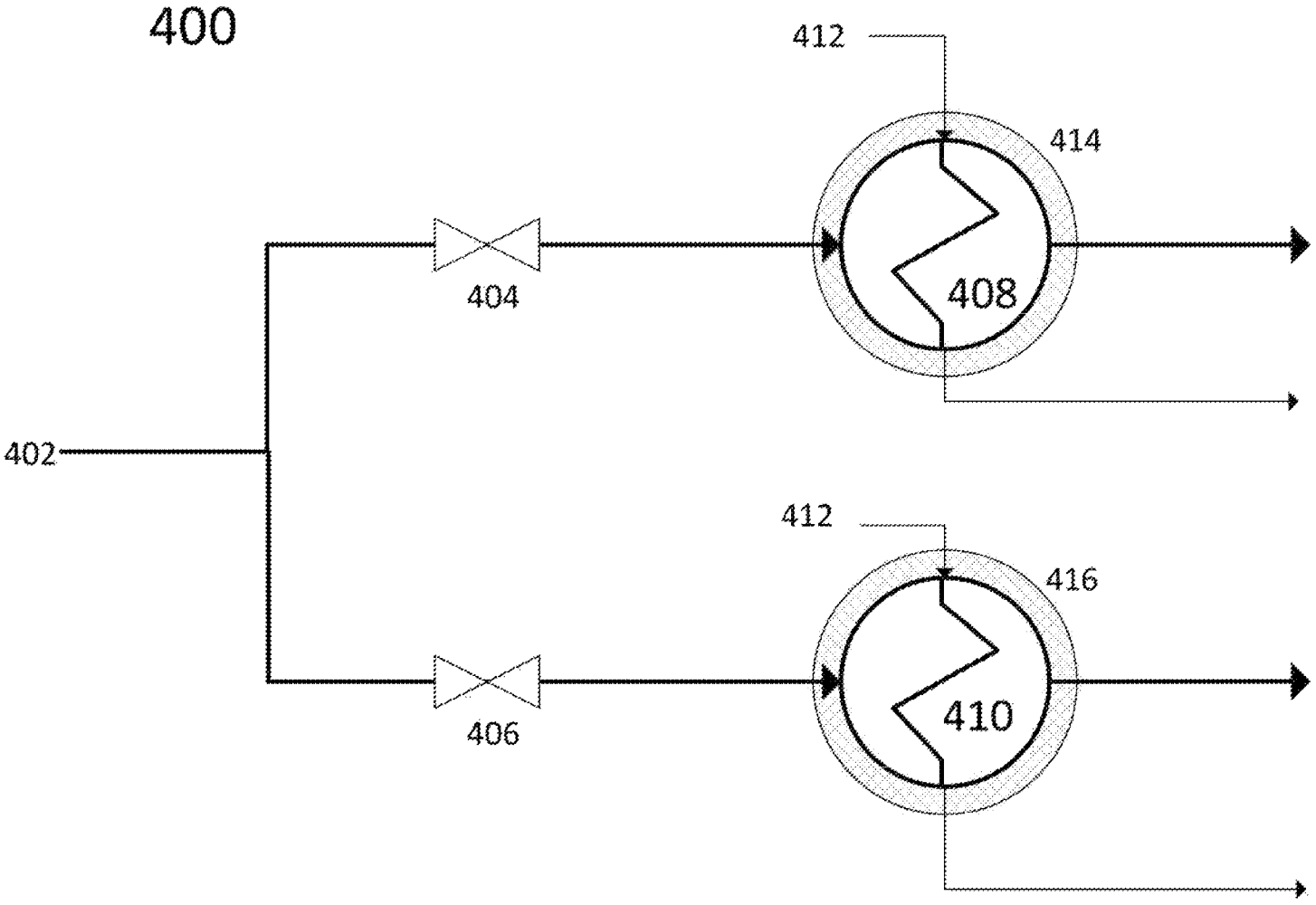
FIG. 4 shows a process flow diagram for one embodiment of the present invention.

Referring to FIG. 4, a process flow diagram 400 is provided, showing one embodiment of the present invention. A contact liquid 402 is provided by pipe to valve 404 and valve 406, in parallel. Initially, valve 404 is open and valve 406 is closed. Contact liquid 402 continues into heat exchanger 408. Contact liquid 402 contains a dissolved gas, an entrained gas, or residual small particles that foul heat exchanger 408 by condensing or depositing as a foulant onto at least a portion of the interior walls of the outer elements of heat exchanger 408, restricting free flow of contact liquid 402. The pressure across heat exchanger 408 is monitored and when the pressure drops, signifying less contact liquid 402 is making it through heat exchanger 408, the flow of coolant 412 to heat exchanger 408 is stopped. Valve 406 is opened and contact liquid 402 begins to flow to heat exchanger 410. Flow of coolant 412 is begun to heat exchanger 410. Valve 404 is closed, stopping flow of contact liquid 402 to heat exchanger 408. At this point, heat exchanger 410 is now in operation while heat exchanger 408 is ready for removal of fouling. Heating element 414 is engaged to warm the outer shell of heat exchanger 408, warming the outer shell directly, and the interior elements by conduction over time, driving off the foulant. The foulant removed, heat exchanger 408 becomes the standby for heat exchanger 410. The same process would be repeated for opposite exchangers when a pressure drop across heat exchanger 410 is detected. Heating elements 416 would be used for removing fouling of heat exchanger 410.

Figure 5:
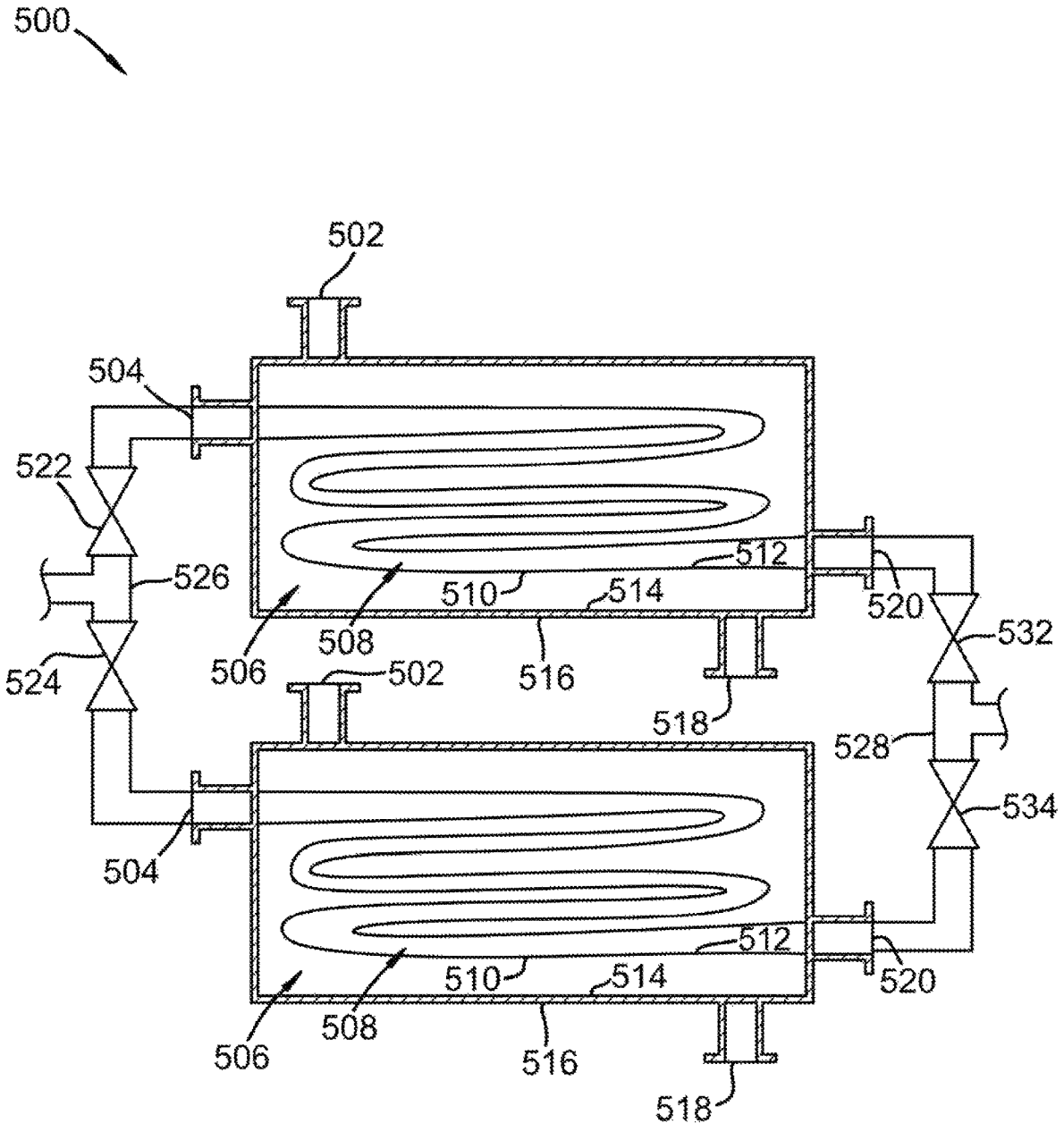
FIG. 5 shows a cross-sectional view of a set of heat exchanger that may be used in one embodiment of the present invention.

Referring to FIG. 5, a cross-sectional view of a set of parallel heat exchangers 500 that may be used in one embodiment of the present invention is shown. Heat exchangers 500 may be used for 208/210, 308/310, and 408/410. Heat exchangers 500 consist of coolant inlets 502, coolant outlets 518, contact liquid inlets 504, contact liquid outlets 520, interior elements 508, exterior walls of interior elements 510, interior walls of interior elements 512, outer shells 506, interior walls of the outer shell 514, and exterior walls of the outer shell 516. Inlet pipe 526 tees to valve 522 and valve 524. The contact liquid is directed by these valves 522 and 524 to the operational heat exchanger. Outlet pipe 528 recombines the outlet through valve 532 and valve 534.

In some embodiments, coolants 112, 212, 312, and 412 comprise liquid nitrogen, ethane, methane, propane, refrigerants, or combinations thereof.

In some embodiments, the heat exchangers comprise brazed plate, aluminum plate, shell and tube, plate, plate and frame, plate and shell, or plate fin style heat exchangers.

In some embodiments, the non-reactive gas comprises nitrogen, methane, argon, or combinations thereof.

In some embodiments, the foulant comprises carbon dioxide, nitrogen oxide, sulfur dioxide, nitrogen dioxide, sulfur trioxide, hydrogen sulfide, mercury, entrained particulate, hydrogen cyanide, impurities of burned fuel, byproducts of burned fuel, or a combination thereof.

In some embodiments, contact liquids 102, 202, and 302 would comprise 1,1,3-trimethylcyclopentane, 1,4-pentadiene, 1,5-hexadiene, 1-butene, 1-methyl-1-ethylcyclopentane, 1-pentene, 2,3,3,3-tetrafluoropropene, 2,3-dimethyl-1-butene, 2-chloro-1,1,1,2-tetrafluoroethane, 2-methylpentane, 3-methyl-1,4-pentadiene, 3-methyl-1-butene, 3-methyl-1-pentene, 3-methylpentane, 4-methyl-1-hexene, 4-methyl-1-pentene, 4-methylcyclopentene, 4-methyl-trans-2-pentene, bromochlorodifluoromethane, bromodifluoromethane, bromotrifluoroethylene, chlorotrifluoroethylene, cis 2-hexene, cis-1,3-pentadiene, cis-2-hexene, cis-2-pentene, dichlorodifluoromethane, difluoromethyl ether, trifluoromethyl ether, dimethyl ether, ethyl fluoride, ethyl mercaptan, hexafluoropropylene, isobutane, isobutene, isobutyl mercaptan, isopentane, isoprene, methyl isopropyl ether, methylcyclohexane, methylcyclopentane, methylcyclopropane, n,n-diethylmethylamine, octafluoropropane, pentafluoroethyl trifluorovinyl ether, propane, sec-butyl mercaptan, trans-2-pentene, trifluoromethyl trifluorovinyl ether, vinyl chloride, bromotrifluoromethane, chlorodifluoromethane, dimethyl silane, ketene, methyl silane, perchloryl fluoride, propylene, vinyl fluoride, or combinations thereof.

In some embodiments, the non-reactive gas is pre-heated and moisture removed by passing the non-reactive gas across a desiccant.

In some embodiments, warm fluid 314 would comprise water, 1,1,3-trimethylcyclopentane, 1,4-pentadiene, 1,5-hexadiene, 1-butene, 1-methyl-1-ethylcyclopentane, 1-pentene, 2,3,3,3-tetrafluoropropene, 2,3-dimethyl-1-butene, 2-chloro-1,1,1,2-tetrafluoroethane, 2-methylpentane, 3-methyl-1,4-pentadiene, 3-methyl-1-butene, 3-methyl-1-pentene, 3-methylpentane, 4-methyl-1-hexene, 4-methyl-1-pentene, 4-methylcyclopentene, 4-methyl-trans-2-pentene, bromochlorodifluoromethane, bromodifluoromethane, bromotrifluoroethylene, chlorotrifluoroethylene, cis 2-hexene, cis-1,3-pentadiene, cis-2-hexene, cis-2-pentene, dichlorodifluoromethane, difluoromethyl ether, trifluoromethyl ether, dimethyl ether, ethyl fluoride, ethyl mercaptan, hexafluoropropylene, isobutane, isobutene, isobutyl mercaptan, isopentane, isoprene, methyl isopropyl ether, methylcyclohexane, methylcyclopentane, methylcyclopropane, n,n-diethylmethylamine, octafluoropropane, pentafluoroethyl trifluorovinyl ether, propane, sec-butyl mercaptan, trans-2-pentene, trifluoromethyl trifluorovinyl ether, vinyl chloride, bromotrifluoromethane, chlorodifluoromethane, dimethyl silane, ketene, methyl silane, perchloryl fluoride, propylene, vinyl fluoride, or combinations thereof.

The invention claimed is:

1. A method for semi-continuous operation of a heat exchange process that alternates between a first heat exchanger and a second heat exchanger, the method comprising:

i) providing a contact liquid to the first heat exchanger and cooling the contact liquid via heat exchange with a coolant while the second heat exchanger is on standby, wherein being on standby means the second heat exchanger is ready to take over operation of the first heat exchanger upon demand; wherein the contact liquid contains a dissolved gas, an entrained gas, or residual small particles that foul the first heat exchanger by condensing or depositing as a foulant onto at least a portion of any interior walls of the first heat exchanger that contact the contact liquid, restricting free flow of the contact liquid;

ii) operating the first heat exchanger while the second heat exchanger is on standby, a pressure drop across the first heat exchanger caused by the foulant, the first heat exchanger operating while the second heat exchanger is on standby;

iii) stopping flow of the coolant to the first heat exchanger and beginning flow of the contact liquid to the second heat exchanger, then stopping flow of the contact liquid to the first heat exchanger and beginning flow of the coolant to the second heat exchanger, thereby causing the second heat exchanger to switch from standby to operation and removing the first heat exchanger from operation to standby; and, iv) removing the foulant from the now standby first heat exchanger by a process comprising:

a. providing heat to the portion of the interior walls of the heat exchanger where the foulant is condensed, b. passing a non-reactive gas across the portion of the interior walls of the heat exchanger where the foulant is condensed; or, c. a combination of the above;

wherein the first heat exchanger and the second heat exchanger thereby switch roles from standby to operating, with steps i to iv repeated with reversed roles; whereby the heat exchange process operates semi-continuously.

2. The method of claim 1, wherein the foulant comprises carbon dioxide, nitrogen oxide, sulfur dioxide, nitrogen dioxide, sulfur trioxide, hydrogen sulfide, mercury, entrained particulate, hydrogen cyanide, impurities of burned fuel, byproducts of burned fuel, or a combination thereof.

3. The method of claim 1, wherein the contact liquid comprises 1,1,3-trimethylcyclopentane, 1,4-pentadiene, 1,5-hexadiene, 1-butene, 1-methyl-1-ethylcyclopentane, 1-pentene, 2,3,3,3-tetrafluoropropene, 2,3-dimethyl-1-butene, 2-chloro-1,1,1,2-tetrafluoroethane, 2-methylpentane, 3-methyl-1,4-pentadiene, 3-methyl-1-butene, 3-methyl-1-pentene, 3-methylpentane, 4-methyl-1-hexene, 4-methyl-1-pentene, 4-methylcyclopentene, 4-methyl-trans-2-pentene, bromochlorodifluoromethane, bromodifluoromethane, bromotrifluoroethylene, chlorotrifluoroethylene, cis 2-hexene, cis-1,3-pentadiene, cis-2-hexene, cis-2-pentene, dichlorodifluoromethane, difluoromethyl ether, trifluoromethyl ether, dimethyl ether, ethyl fluoride, ethyl mercaptan, hexafluoropropylene, isobutane, isobutene, isobutyl mercaptan, isopentane, isoprene, methyl isopropyl ether, methylcyclohexane, methylcyclopentane, methylcyclopropane, n,n-diethylmethylamine, octafluoropropane, pentafluoroethyl trifluorovinyl ether, propane, sec-butyl mercaptan, trans-2-pentene, trifluoromethyl trifluorovinyl ether, vinyl chloride, bromotrifluoromethane, chlorodifluoromethane, dimethyl silane, ketene, methyl silane, perchloryl fluoride, propylene, vinyl fluoride, or combinations thereof.

4. The method of claim 1, wherein the coolant comprises liquid nitrogen, ethane, methane, propane, refrigerants, or combinations thereof.

5. The method of claim 1, wherein the first heat exchanger and second heat exchanger comprise brazed plate, aluminum plate, shell and tube, plate, plate and frame, plate and shell, or plate fin style heat exchangers.

6. The method of claim 5, wherein the first heat exchanger and second heat exchanger are shell and tube style heat exchangers, containing a shell enclosing a tube, wherein the tube has a varying diameter.

7. The method of claim 1, wherein the non-reactive gas comprises nitrogen, methane, argon, or combinations thereof.

8. The method of claim 1, wherein the non-reactive gas is pre-heated and moisture removed by passing the non-reactive gas across a desiccant.

9. The method of claim 1, wherein the heat provided to the interior walls of the first heat exchanger is provided by heating elements attached to the heat exchanger.

10. The method of claim 9, wherein the heating elements are attached to an exterior wall of the first heat exchanger.

11. The method of claim 10, wherein the contact liquid travels through the exterior elements of the first heat exchanger.

12. The method of claim 9, wherein the contact liquid travels through interior elements of the first heat exchanger, and wherein the heating elements are attached to the outside of the interior elements.

13. The method of claim 12, wherein the heating elements are comprised of piezoelectric heaters, heat trace tape, heat trace sheets, band heaters, or combinations thereof.

14. The method of claim 12, wherein the heating elements are located at the inlet and outlet of the interior elements to the first heat exchanger, and wherein the heating elements warm only the portion of the interior elements that extend out of the first heat exchanger, wherein heat is conducted along the interior elements.

15. The method of claim 9, wherein the heating elements are attached to the inside of the interior elements.

16. The method of claim 9, wherein, after stopping flow of the contact liquid to the first heat exchanger, the connections to the interior elements by external piping are disconnected and the heating elements are inserted into the inside of the interior elements.

17. The method of claim 1, wherein the contact liquid travels through interior elements of the first heat exchanger, and wherein the heat provided to the interior walls of the first heat exchanger is provided by passing a warm fluid through the outer elements of the heat exchanger.

18. The method of claim 17, wherein the warm fluid comprises air, nitrogen, carbon dioxide, argon, or combinations thereof.

19. The method of claim 17, wherein the warm fluid comprises water, 1,1,3-trimethylcyclopentane, 1,4-pentadiene, 1,5-hexadiene, 1-butene, 1-methyl-1-ethylcyclopentane, 1-pentene, 2,3,3,3-tetrafluoropropene, 2,3-dimethyl-1-butene, 2-chloro-1,1,1,2-tetrafluoroethane, 2-methylpentane, 3-methyl-1,4-pentadiene, 3-methyl-1-butene, 3-methyl-1-pentene, 3-methylpentane, 4-methyl-1-hexene, 4-methyl-1-pentene, 4-methylcyclopentene, 4-methyl-trans-2-pentene, bromochlorodifluoromethane, bromodifluoromethane, bromotrifluoroethylene, chlorotrifluoroethylene, cis 2-hexene, cis-1,3-pentadiene, cis-2-hexene, cis-2-pentene, dichlorodifluoromethane, difluoromethyl ether, trifluoromethyl ether, dimethyl ether, ethyl fluoride, ethyl mercaptan, hexafluoropropylene, isobutane, isobutene, isobutyl mercaptan, isopentane, isoprene, methyl isopropyl ether, methylcyclohexane, methylcyclopentane, methylcyclopropane, n,n-diethylmethylamine, octafluoropropane, pentafluoroethyl trifluorovinyl ether, propane, sec-butyl mercaptan, trans-2-pentene, trifluoromethyl trifluorovinyl ether, vinyl chloride, bromotrifluoromethane, chlorodifluoromethane, dimethyl silane, ketene, methyl silane, perchloryl fluoride, propylene, vinyl fluoride, or combinations thereof.

20. The method of claim 19, wherein the heating elements are comprised of piezoelectric heaters, heat trace tape, heat trace sheets, or combinations thereof.

* * * * *